United States Patent [19]

Peterson

[11] 4,373,694

[45] Feb. 15, 1983

[54] ADJUSTABLE SHELF SUPPORT

[75] Inventor: Francis C. Peterson, St. Charles, Ill.

[73] Assignee: Illinois Tool Works Inc., Chicago, Ill.

[21] Appl. No.: 245,829

[22] Filed: Mar. 20, 1981

[51] Int. Cl.[3] ..... A47G 29/02

[52] U.S. Cl. ..... 248/246; 108/108

[58] Field of Search ..... 248/235, 248, 247, 246, 248/243, 222.3; 108/108; 211/90, 187

[56] References Cited

U.S. PATENT DOCUMENTS

| | | | |
|---|---|---|---|
| 619,416 | 2/1899 | Hunter | 108/27 |
| 2,703,692 | 3/1955 | Felix | 248/244 |
| 2,876,971 | 3/1959 | Poupitch | 248/225 |
| 2,901,205 | 8/1959 | Gredell | 248/245 |
| 3,039,727 | 6/1962 | Engel, Jr. et al. | 248/245 |
| 3,368,784 | 2/1968 | Peterson | 248/245 |
| 3,491,974 | 1/1970 | Swanquist | 248/223 |
| 3,652,032 | 3/1972 | Eros et al. | 248/225 |
| 3,664,627 | 5/1972 | Sykes et al. | 248/246 |
| 3,704,675 | 12/1972 | Bellasalma | 248/223 |
| 3,730,468 | 5/1973 | Magnusen | 108/108 X |
| 3,834,659 | 9/1974 | Siegal | 248/245 |
| 3,847,489 | 11/1974 | Van Riper | 248/245 |
| 3,848,844 | 11/1974 | Barrett | 248/245 |
| 3,886,703 | 6/1975 | Rousey | 248/225 |
| 4,040,588 | 8/1977 | Papsco et al. | 248/245 |
| 4,103,855 | 8/1978 | Grosse | 108/108 X |
| 4,205,815 | 6/1980 | Sauer et al. | 248/243 |
| 4,223,863 | 9/1980 | Birman | 248/246 |
| 4,299,368 | 11/1981 | Winkler | 108/108 X |

FOREIGN PATENT DOCUMENTS

| | | | |
|---|---|---|---|
| 638333 | 3/1962 | Canada | 211/90 |
| 18650 | 12/1980 | European Pat. Off. | 248/246 |
| 1388531 | 12/1964 | France | 248/246 |
| 277632 | 9/1930 | Italy | 108/108 |
| 1189189 | 4/1970 | United Kingdom | 248/243 |

*Primary Examiner*—J. Franklin Foss

*Attorney, Agent, or Firm*—Thomas W. Buckman; Jerold M. Forsberg; Jack Halvorsen

[57] ABSTRACT

An adjustable shelf support having a standard with a shelf bracket capable of infinite adjustability. The standard has a L-shaped cross section, a first leg of the 'L' lying along the supporting surface and a second leg extending outwardly therefrom. The free end of the second leg is folded back towards the first leg forming two parallel, spaced extensions. The bracket is planar with two fingers extending outwardly from but parallel to the plane of the bracket. The upper finger is inserted behind the free end of the second leg by rotating the bracket downward. This brings the flat trailing edge between two protrusions formed on the first arm and allows the second finger to snap into place behind the free end of the second leg, thereby, preventing accidental dislodgement by an upward force. The distance between the flat trailing edge and the farthest extent of the first protrusion slightly exceeds the length of the inner wall of the second leg. In engaged position, the bracket is firmly wedged and maintained in place by frictional forces.

5 Claims, 6 Drawing Figures

ADJUSTABLE SHELF SUPPORT

BACKGROUND AND SUMMARY OF THE INVENTION

The present invention is directed to a shelf support with infinite adjustability.

Typically, shelf supports include a vertical standard with a plurality of adjustment apertures and a bracket with tangs that engage in the apertures. Regardless of the number of apertures, the adjustment capabilities are, nonetheless, restricted. If the number of apertures is increased to improve the adjustment capabilities, the standard is weakened by the removal of material and the cost of manufacture is also increased.

More recently, efforts have been made to develop shelf supports with infinite adjustment capability. While some of these attempts have been successful, the resulting solutions are more costly than the systems they replace. The standards are complicated extrusions and the brackets also embody complex configurations or use costly mounting hardware.

The present invention overcomes these difficulties providing an effective, yet simple, infinitely adjustable support which can be economically manufactured. The standard has a generally L-shaped cross section with a first leg that will mount to a wall or other flat surface and a second leg which will extend laterally outwardly. The first leg has at least two protruding ribs or the like, and the second leg has its free end turned back toward the first leg forming two generally parallel extensions which are spaced from each other.

The bracket is a generally planar member with a flat vertical edge. Adjacent the flat edge are two finger-like members which are bent outwardly from the plane of the bracket and engage in between the two parallel extensions. With the upper finger engaged between the extensions, the bracket is rotated about an axis which is perpendicular to the axis of the bracket so that the flat edge is positioned between the protrusions and the lower finger snapped into position between the extension. The distance between the flat edge and the farthest extremity of the first finger slightly exceeds the length of the inside wall of the protruding leg of the standard so that the bracket is wedged into position. Frictional forces maintain the bracket, shelf and its load in fixed position relative to the shelf standard. Spacers, or the like, to keep the channel-shaped standard from collapsing are also made unnecessary by this design.

Other features, characteristics and advantages of the present invention will become apparent after a reading of the following specification taken in conjunction with the accompanying drawings.

DETAILED DESCRIPTION OF THE PREFERRED EMBODIMENTS

Figure 1:
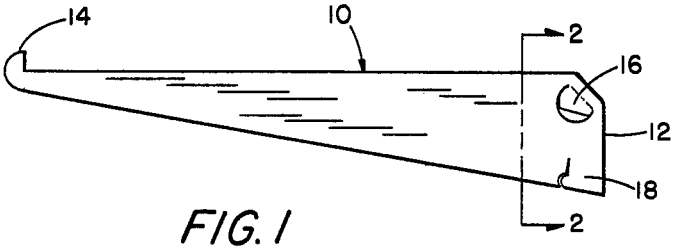
FIG. 1 is a side view of the bracket portion of the adjustable support of the present invention.
Figure 2:
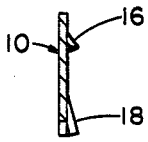
FIG. 2 is a cross-sectional and view of the bracket shown in FIG. 1 as seen along line 2—2.

The shelf bracket of the present invention is depicted in FIGS. 1 and 2 generally at 10. Bracket 10 has a generally planar configuration and a flat vertical edge 12. While this embodiment has been depicted as generally triangular having a hook 4 at its free end, the shape will vary with the type of shelf to be supported. The bracket here is intended for use with a metal grate such as are used in refrigerators and the like. It will further be appreciated that the supports of the present invention will generally be used in groups of two or more to support a particular shelf, even though only one support is depicted in the drawings.

Two finger-like members 16 and 18 are formed by slicing through the thickness of material forming bracket 10 and deflecting the fingers toward the same side of the bracket. Some of the material forming finger 16 is removed to form a flat 17 to facilitate insertion. As will become more apparent when FIGS. 3 and 4 are described, finger 16 is the primary engaging member while finger 18 prevents the bracket 10 from being accidentally dislodged from its standard by an upward force.

Figure 3:
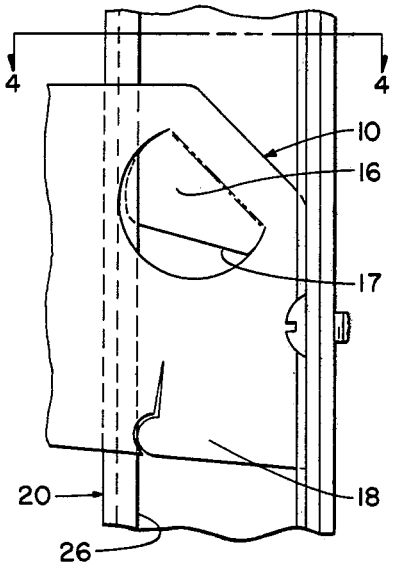
FIG. 3 is an enlarged fragmentary side view of the adjustable support of the present invention.
Figure 4:
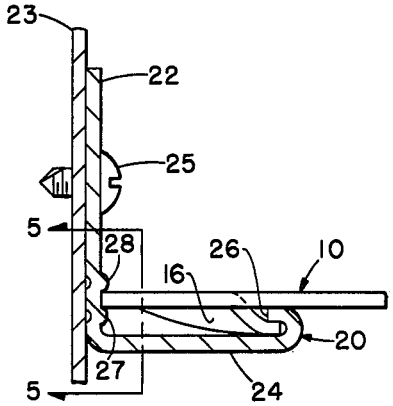
FIG. 4 is a cross-sectional top view as seen along lines 4—4 in FIG. 3.

As best seen in FIGS. 3 and 4, the adjustable support of the present invention also includes a shelf standard 20. Standard 20 will be mounted on a flat surface such as a wall or cabinet or the like. The standard is a generally L-shaped member comprised of a first leg 22 adapted for mounting on flat surface 23 by fastener 25 which may be of the self-drilling type, and a second leg 24 projecting laterally outwardly from the wall. The free end 26 of leg 24 is bent back toward said first leg 22 thereby forming two generally parallel extensions with a predetermined distance therebetween. That distance is substantially equal to the thickness of bracket 10. A pair of protrusions 27 and 28 are formed on the first leg 22, the first protrusion being generally opposite end 26 and the two protrusions 27, 28 being spaced by a distance substantially equal to the thickness of bracket 10.

In inserting bracket 10 in standard 20, the bracket is positioned such that flat 17 is adjacent free end 26 and then the bracket rotated about an axis which is perpendicular to it so that a portion of finger 16 is behind free end 26 between the parallel extensions. The flat edge 12 is positioned between protrusions 27 and 28 and finger 18 snapped behind free end 26. The distance between flat edge 12 and the farthest extremity of finger 16 is slightly greater than the length of the inside surface of leg 24 so that finger 16 is firmly wedged between the parallel extensions. Fastener 25 securing the standard to surface 23 is positioned far enough out on leg 22 so as not to interfere with the pivotal movement. Accordingly, the shelf bracket 10 may be attached to standard 20 at any point along its length without restriction.

Figure 5:
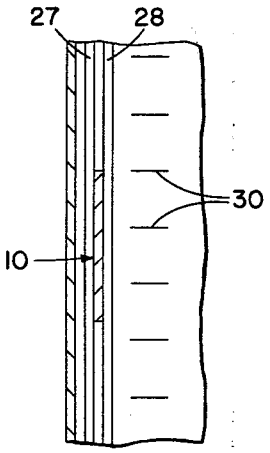
FIG. 5 is a fragmentary cross-sectional side view of the support of the present invention as seen along lines 5—5 in FIG. 4.
Figure 6:
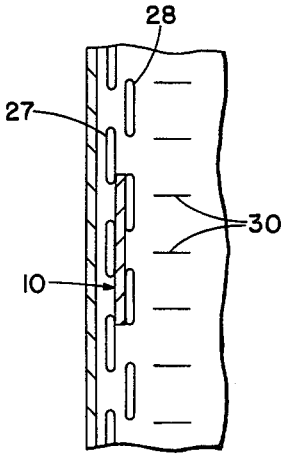
FIG. 6 is a view similar to that shown in FIG. 5 of an alternate form of the present invention.

FIGS. 5 and 6 show two different forms of protrusions 27 and 28. In FIG. 5, the protrusions are formed by two ribs which extend substantially throughout the length of standard 20. In FIG. 6, protrusions are formed by two rows of bumps. These rows are preferably offset from one another, adjacent bumps in each row being spaced by a distance which is less than the length of flat edge 12. Thereby, the sides of bracket 10 is contacted by a minimum of three such bumps, two on one side and one on the other, to keep the rear portion of the bracket from twisting about its axis or about an axis parallel to the axis of the standard. Indicia as shown at 30 will be provided so that shelf brackets on different standards may be positioned at the same height.

FIGS. 1 and 2 show fingers 16 and 18 deflected to one side and FIGS. 3 and 4 to the other. Obviously, the brackets can be made either right-handed or left-handed or both with the standard 20 merely turned end-for-end to accomodate the other brackets. Typically, the brackets will be half right-handed and half left-handed with the two legs 24 of paired standards 20 being positioned outwardly to resist inward forces.

Various changes, alterations and modifications will become apparent following a reading of the foregoing specification. Accordingly, it is intended that all such changes, alterations and modifications as fall within the scope of the appended claims be considered part of this invention.

I claim:

1. An adjustable shelf support comprising an elongated L-shaped standard for supporting a bracket, a first leg of said L-shaped standard having parallel protrusion means to prevent lateral movement of the bracket, said first leg adapted to be placed against and fastened to a vertical surface, a second leg of said L-shaped standard having a free end bent back toward said first leg to form parallel portions with a predetermined distance therebetween, a substantially planar bracket having a thickness substantially equal to said predetermined distance including a flat vertical edge for engaging said protrusion means, first and second finger means bent out of the plane of said bracket for engaging the secong leg of said standard, said first finger means to limit downward rotation of said bracket, said second finger means to limit upward rotation of said bracket, said second finger means being flexible so as to snap into a position adjacent to said free end of said second leg whereby upward rotation of said bracket causes said second finger means to move to a position between said parallel portions thereby positively preventing both continued upward rotation and lateral movement of said bracket.

2. The adjustable shelf support of claim 1 wherein the protrusion means are formed by parallel ribs extending substantially the entire length of the standard.

3. The adjustable shelf support of claim 1 wherein the protrusion means are formed by parallel rows of bumps, the bumps in each row being spaced by a distance which is less than the length of said flat edge.

4. The adjustable shelf support of claim 1 wherein said second finger means is bent out of the plane of the bracket by a distance less than the thickness of said standard such that said first finger means must be sprung outwardly to be fitted into said standard thereby creating spring retention forces.

5. The adjustable shelf support of claim 1 wherein a portion of said first finger is located a predetermined distance from said edge, said distance measured perpendicularly to said edge and slightly exceeding the length of the inner wall of said second leg whereby said bracket is firmly wedged between said legs of said standard.

* * * * *